US007665405B2

(12) United States Patent
Evans et al.

(10) Patent No.: US 7,665,405 B2
(45) Date of Patent: Feb. 23, 2010

(54) FORCE DEFLECTOR

(75) Inventors: Lyle Evans, Spanish Fork, UT (US); Richard Stepp, Springville, UT (US)

(73) Assignee: Provo Steel & Supply, Provo, UT (US)

( * ) Notice: Subject to any disclaimer, the term of this patent is extended or adjusted under 35 U.S.C. 154(b) by 92 days.

(21) Appl. No.: 11/431,233

(22) Filed: May 10, 2006

(65) Prior Publication Data

US 2007/0261615 A1 Nov. 15, 2007

(51) Int. Cl.
*E05G 1/04* (2006.01)

(52) U.S. Cl. ..... 109/59 R; 70/118; 70/120

(58) Field of Classification Search ..... 109/59 R; 70/118–120, 257, 283
See application file for complete search history.

(56) References Cited

U.S. PATENT DOCUMENTS 1,673,468 A * 6/1928 Palinkas ..... 70/120
4,147,044 A 4/1979 Bernath
4,148,265 A 4/1979 Acosta
4,187,704 A 2/1980 Ristic-Petrovic
4,232,613 A 11/1980 Kempf
4,266,488 A 5/1981 Markham
4,432,573 A 2/1984 Goldman
4,446,798 A 5/1984 Withington
4,468,943 A 9/1984 Beattie et al.
4,470,275 A 9/1984 Fisher
4,470,277 A 9/1984 Uyeda
4,493,199 A 1/1985 Uyeda
4,520,736 A 6/1985 Crosby et al.
4,539,828 A 9/1985 Teleky
4,543,748 A 10/1985 North, Jr.
4,621,845 A 11/1986 Vanago
4,640,111 A 2/1987 Hashizume
4,669,394 A 6/1987 Fogleman et al.
4,671,086 A 6/1987 Fogleman et al.
4,679,415 A 7/1987 Spratt
4,683,732 A 8/1987 Beattie
4,688,492 A 8/1987 Peghetti
4,754,715 A 7/1988 Squires
5,067,755 A 11/1991 James
5,088,776 A 2/1992 James
5,094,483 A 3/1992 James
5,111,674 A 5/1992 Huang
5,134,870 A 8/1992 Uyeda et al.
5,142,890 A 9/1992 Uyeda et al.
5,245,846 A 9/1993 James
5,341,752 A 8/1994 Hambleton
5,597,187 A 1/1997 Hjorth
5,778,708 A 7/1998 Crosby et al.
5,946,954 A 9/1999 Emery et al.
6,474,248 B1 11/2002 Stark et al.
6,679,087 B2 * 1/2004 Suggs et al. ..... 70/153
2003/0140665 A1 * 7/2003 Szuminski et al. ..... 70/257

* cited by examiner

*Primary Examiner*—Suzanne D Barrett
(74) *Attorney, Agent, or Firm*—Everett D. Robinson; Echelon IP, LLC

(57) ABSTRACT

Disclosed herein are various exemplary mechanisms by which external forces applied to doors and their locking mechanisms are deflected or directed away from the critical components of the locking system thereby preserving the integrity of the locking system and preventing unauthorized entry. Detailed information on various example embodiments of the inventions are provided in the Detailed Description below, and the inventions are defined by the appended claims.

11 Claims, 7 Drawing Sheets

FORCE DEFLECTOR

BACKGROUND

The claimed inventions relate generally to locking mechanisms, particularly those for doors, and more particularly, to safe or security doors. The claimed inventions concern mechanisms that improve the ability of such doors and their locking systems to withstand external forces intended to disable the locking systems and allow unauthorized entry.

BRIEF SUMMARY

Disclosed herein are various exemplary mechanisms by which external forces applied to doors and their locking mechanisms are deflected or directed away from the critical components of the locking system thereby preserving the integrity of the locking system and preventing unauthorized entry. Detailed information on various example embodiments of the inventions are provided in the Detailed Description below, and the inventions are defined by the appended claims.

Figure 1A:
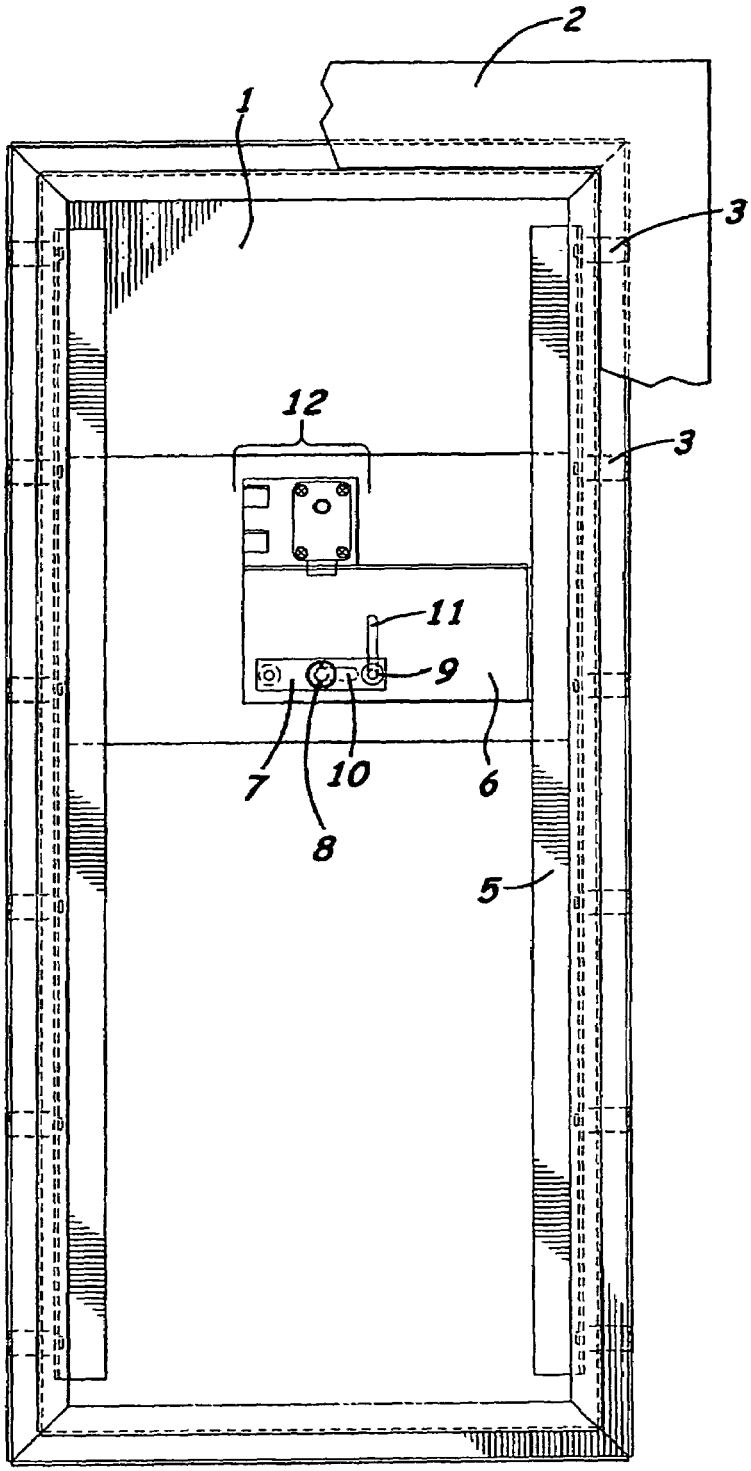
FIGS. 1A, 1B, 1C and 1D show an exemplary force deflector with a force transfer plate, locking pins, locking pin connection plate, and single bar force transfer actuator mounted on a safe door.

Reference will now be made in detail to various systems incorporating a force deflector with a force transfer plate and force actuator bar that may include some embodiments of the claimed inventions, examples of which are illustrated in the accompanying drawings.

DETAILED DESCRIPTION

Many persons have come to rely on security devices such as safes and security doors to protect themselves and their property. To use such a security safe or security door and take advantage of its security features and protection, one must operate a locking system that allows only certain operators access to inside the safe or inside the security door. Typically, such a locking system involves the actual lock, but also a wheel or handle or other such device used, usually by turning, to disengage the latch of the safe or security door and allow the same to be opened after the actual lock has been deactivated. The operation of such a typical locking system usually involves closing the safe door or security door, turning the wheel or handle or otherwise activating a latch or series of locking pins, which engage the door frame, to prevent the safe door or security door from being opened, and then activating a lock to prevent the latch or series of pins from being deactivated without the proper entry permission parameter, such as a combination or key to the lock or locking system. When the operator correctly uses the combination or key to activate the lock and lock the safe or security door, the operator causes a physical object, sometimes referred to as a "tongue" to move into a certain position in contact or near contact with the latch or locking pins, thereby preventing the latch or locking pins from disengaging from the door frame. Accordingly, unless the operator uses the proper entry permission parameter, such as a combination or a key, the latch or locking pins will not disengage and the lock will not be deactivated and the safe or security door remains locked.

Over time those persons desiring to open a safe or security door without the proper entry permission parameter have devised numerous methods of doing so. One particularly effective and simple method of gaining such unauthorized entry involves supplying force to one or more of the latches or locking pins engaged in the door frame. Typically, this is done by drilling through the outside wall of the safe or security door frame to expose a latch or locking pin or pins. A force is then applied to the latch or locking pin, usually by striking the latch or pin with a physical object. That force is transferred through the latch or locking pin back to the lock tongue. If the applied force is great enough, the tongue is sheared or otherwise broken or disabled. As the tongue is the main component of the lock or locking system, once it is sheared off, disabled, or broken, the wheel or handle or other such device on the outside of the safe or security door can be activated to disengage the latch or locking pins from the door frame. At that point the safe or security door is opened, and access is gained to the persons or property within the safe or security door, without the use of the proper entry permission parameter combination or key.

Figure 1B:
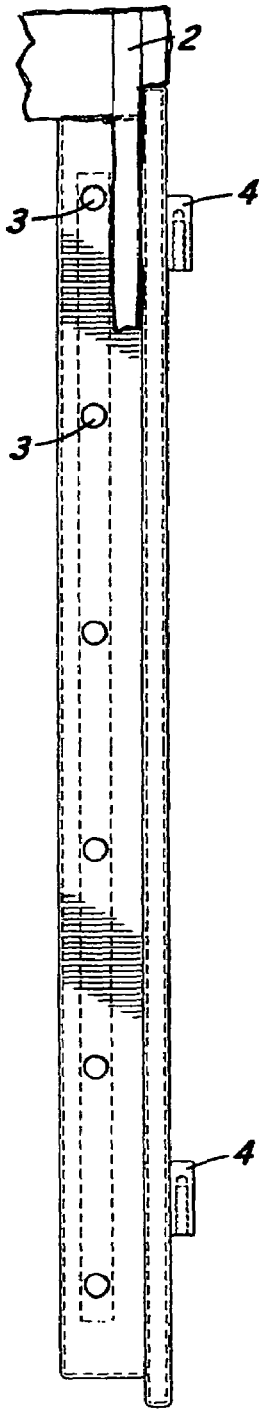

Referring now to FIGS. 1A and 1B, an exemplary force deflector system is depicted in locked position. Door 1 resides within door frame 2, which is connected to the sides of the safe or security door, and engages the door frame 2 by a series of locking pins or latches 3. Door 1 opens through the operation of hinges 4. Door 1 has attached to it a locking pin connection plate or latch plate 5, which is likewise welded or otherwise attached to locking pins 3. FIG. 1B shows the locking pins 3 and the safe or security door from the side view. When in the locked position as shown in FIG. 1A, the locking pins 3 extend through the side of the safe or security door 1 and behind (shown) or into (not shown) the door frame 2 and engage the door frame 2 (and the sides of the safe or security door, if desired) to prevent the door from opening.

As shown in FIG. 1A, one locking pin connection plate or bar 5 is depicted as a long narrow plate attached to the door 1 that has its long axis parallel to the long axis of the door 1, but there may be any number of plates, and they may be of any size or shape and may or may not be attached to the door, or they may be attached indirectly or directly. Also in this example and as shown in FIG. 1A, the locking pin connection plate 5 is attached to a force transfer plate or bar 6 and a single bar force transfer actuator 7, which is a plate or rod that, as more fully explained below, is connected directly or indirectly with the wheel or handle or other such device on the outside of the safe or security door and as the operator turns or otherwise activates the wheel or handle on the outside of the door, the single bar force transfer actuator 7 also turns or is activated.

Figure 1C:
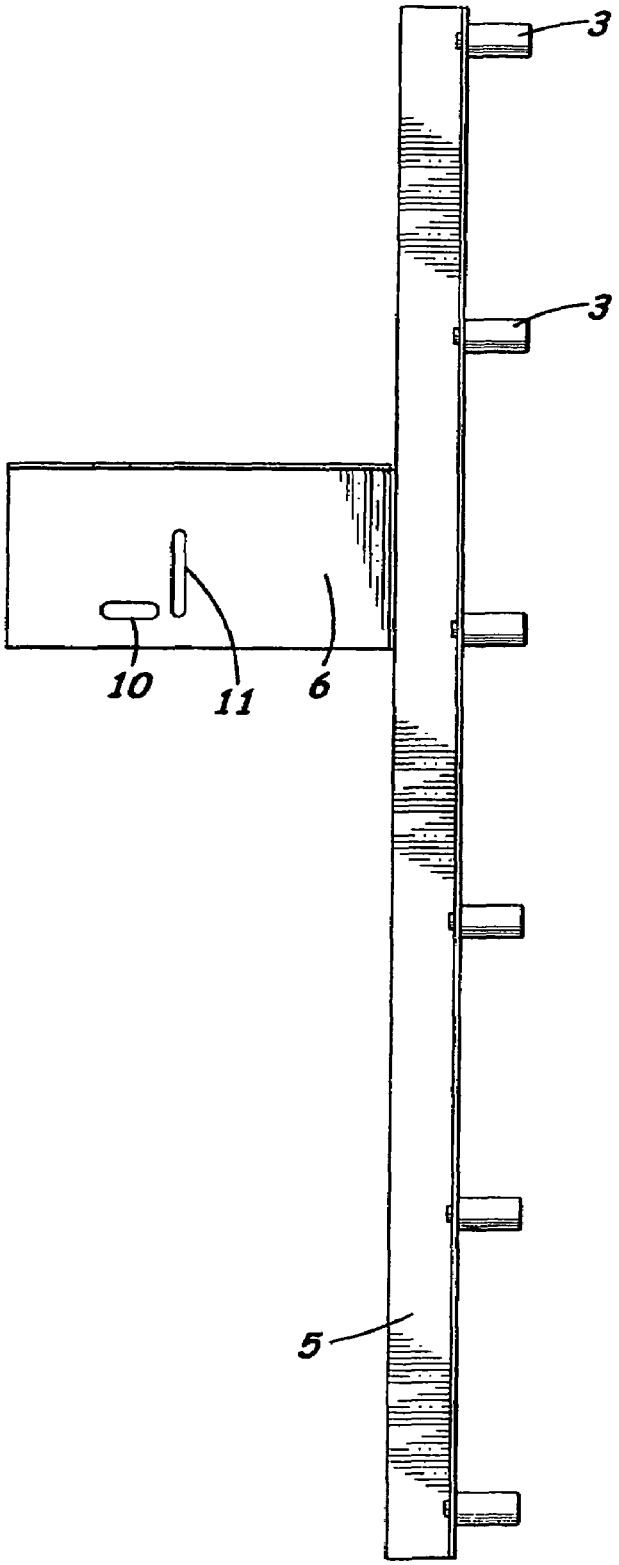
Figure 1D:
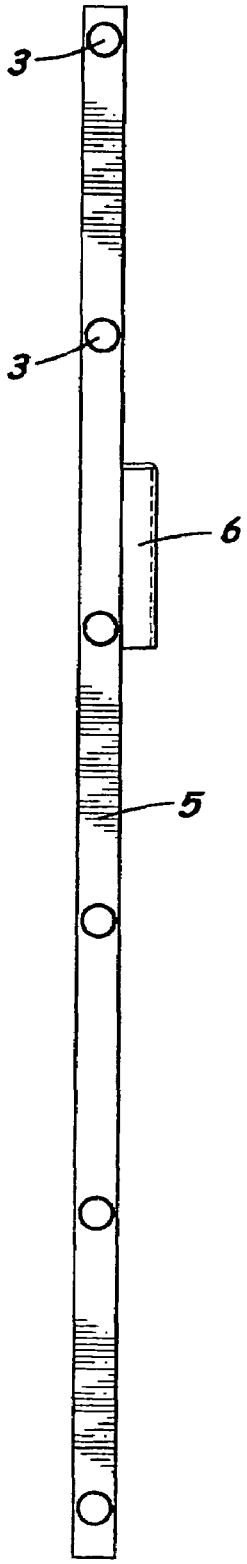

As more specifically shown in FIGS. 1C and 1D, the locking pins 3 are welded or otherwise connected to the locking pin connection plate 5. FIG. 1C shows the locking pins 3, the locking pin connection plate 5, and the force transfer plate 6 without the safe or security door. As shown, the locking pin connection plate 5 is welded or otherwise attached to the force transfer plate 6. FIG. 1D shows the locking pins 3, the locking pin connection plate 5, and the force transfer plate 6 from the side view without the safe or security door.

Although FIGS. 1A and 1C show only one locking pin connection plate 5 on one side of the door and only one force transfer plate 6 and single bar force transfer actuator 7, another locking pin connection plate 5 could be used on the other side of the door with a separate force transfer plate 6 and single bar force transfer actuator 7. Indeed, those skilled in the art will appreciate that additional locking pin connection plates 5 may be used, on any side of the door (left, right, top, and bottom), and each such plates may interact with separate force transfer plates 6 and single bar force transfer actuators 7, or multiple such force transfer plates and actuators.

Figure 2A:
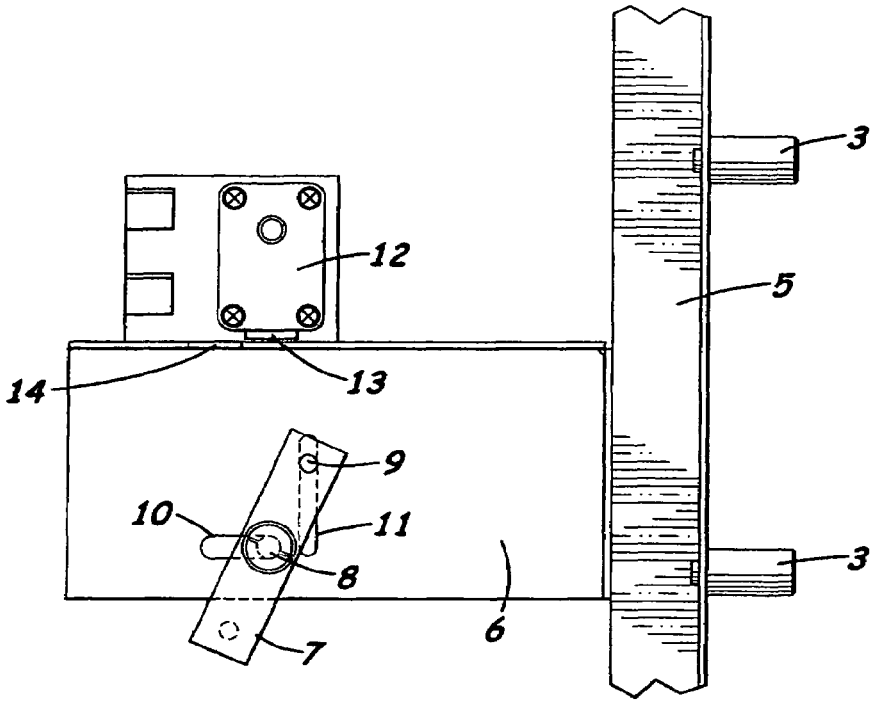
FIGS. 2A, 2B, 2C, and 2D show an exemplary force transfer plate with a single bar force transfer actuator, a rotational entry shaft, a force transfer shaft, and a locking mechanism.
Figure 2B:
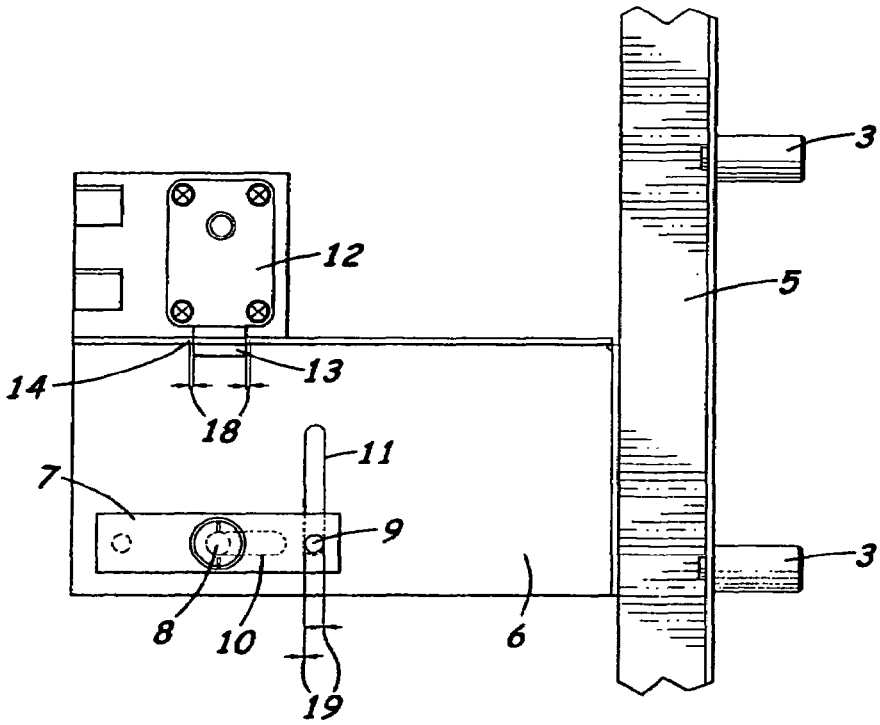

Referring now to FIGS. 2A, 2B, 2C, and 2D the components and operation of an exemplary force deflector are further described. As shown in FIGS. 2A and 2B, the force deflector includes a rotational entry shaft or pin 8 and a force transfer shaft or pin 9, which are both welded or otherwise connected (such as by a slip collar) to the single bar force actuator 7. The rotational entry shaft 8 is a physical object, typically cylindrical in shape, that projects through the door, from the handle or other opening mechanism on the outside, through the door itself, through an opening (described in more detail below) in the force transfer plate 6, and finally is welded or otherwise connected to the single bar force transfer actuator 7.

The rotational entry shaft 8 may be of any length necessary to allow communication between the wheel or handle or other opening mechanism on the outside of the door and the single bar force transfer actuator 7 on the inside of the door. Likewise, the rotational entry shaft 8 may be of any shape, including square or rectangular in cross section. The rotational entry shaft 8 is also in contact with the safe or security door, in a manner that allows the shaft to engage the door but still rotate when operated, through any one of many methods well known to those of skill in the art, such as through use of bearings.

The force transfer shaft 9 does not run through the door, but instead is welded or otherwise attached to the single bar force transfer actuator 7 on the inside of the door and projects toward the outside of the door through an opening in the force transfer plate 6. Similar to the rotational entry shaft 8, the force transfer shaft 9 may be of any length or shape necessary to allow communication between the single bar force transfer actuator 7 and the force transfer plate 6.

The positions of the rotational entry shaft 8 and the force transfer shaft 9 are shown by example only, and those of skill in the art will appreciate that those positions can by varied at any point along the single bar force transfer actuator 7 to achieve many objectives, such as increased performance or ease of construction, and still fall within the present invention.

Figure 2D:
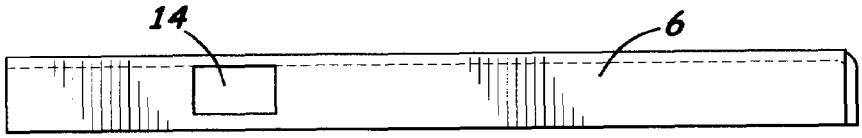
Figure 2C:
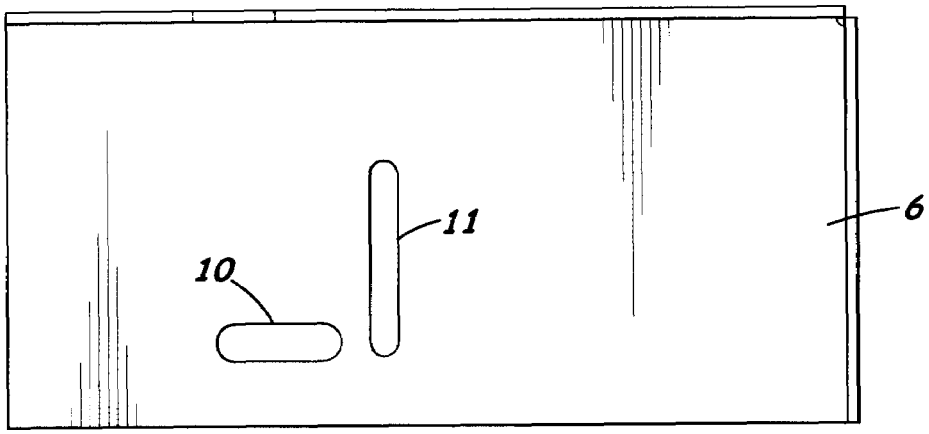

FIG. 2C is a more detailed view of the openings in the force transfer plate through which the rotational entry shaft 8 and the force transfer shaft 9 pass. In its position of communication between the handle or other opening mechanism on the outside of the safe or security door and the single bar force transfer actuator 7 on the inside of the safe or security door, the rotational entry shaft 8 passes through the rotational shaft travel slot 10, which is an aperture or opening in the force transfer plate 6. The rotational shaft travel slot 10 may be of any shape, but as more particularly described below, must be large enough to permit the force transfer plate 6 (and therefore the connected single bar force transfer actuator 7 and force transfer shaft 9) to rotate and move spatially. Likewise, in its position of attachment with the single bar force transfer actuator 7, the force transfer shaft 9 passes through the force transfer shaft travel slot 11, which is another aperture or opening in the force transfer plate 6. The force transfer shaft travel slot 11 may also be of any shape, but similar to the rotational shaft travel slot 10, and as more particularly described below, it also must be large enough to permit the force transfer plate 6 (and therefore the connected single bar force transfer actuator 7 and force transfer shaft 9) to rotate and move spatially.

In normal or typical operation, when an operator desires to lock the safe or security door, or in other words to secure the door from unauthorized entry, the operator activates the lock or locking mechanism 12, and more particularly the tongue or bar of the locking mechanism 13, which then engages the force transfer plate through slot 14 to prevent the movement of the force transfer plate, and therefore the movement of the locking pins out of the door frame. The slot 14 in the force transfer plate 6 is an aperture or opening through which the tongue 13 passes when the locking mechanism 12 is activated. Similar to the rotational shaft travel slot 10 or the force transfer travel slot 11, the slot 14 allows an object to pass through another object. In case of slot 14, it allows the tongue 13 to engage the force transfer plate 6, and prevent the force transfer plate 6 from moving, when the tongue 13 passes through the slot 14 in the force transfer plate 6.

Assuming as shown in FIG. 2A that the safe or security door is unlocked, or in other words that the locking mechanism tongue 13 is withdrawn from the tongue locking slot 14 in the force transfer plate 6, then the safe or security door is free to open when the handle or other opening mechanism is activated. In FIG. 2A, the safe or security door is unlocked and the wheel or handle or other such mechanism on the outside of the door has been turned so as to also turn the force transfer actuator 7, and as described in more detail below, the safe or security door is in a position to be pulled open. As shown, the force transfer plate 6 (and therefore the locking pin connection plate 5 and locking pins 3) have been moved spatially as a result of the tongue 13 being withdrawn from the slot 14.

FIG. 2D is a more detailed view of the top of the force transfer plate 6, showing the slot 14 into which the tongue 13 projects when the locking mechanism 12 is activated using the proper entry permission parameter, such as a combination or a key.

Figure 3A:
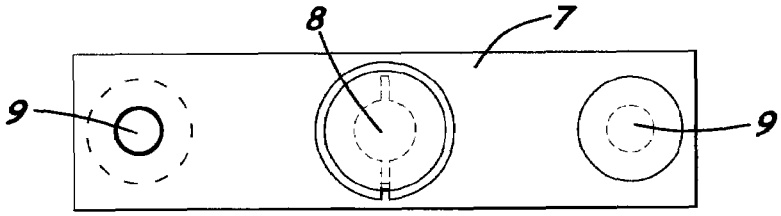
FIGS. 3A and 3B show an exemplary single bar force actuator and force transfer pin.
Figure 3B:
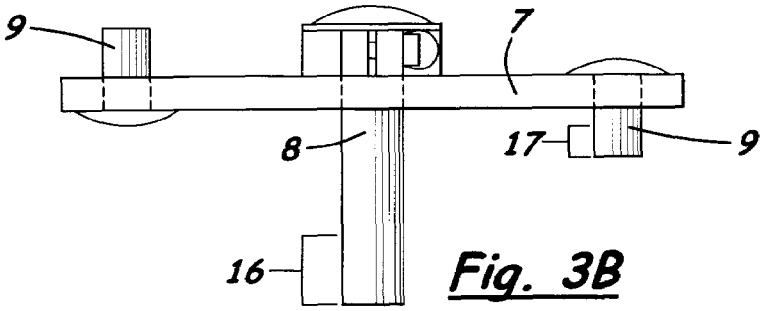

FIGS. 3A and 3B show a more detailed view of the single bar force transfer actuator 7. As shown in FIG. 3A, the rotational entry shaft 8 is positioned between the force transfer shaft 9 and an optional secondary force transfer shaft 9 shown at position 15. The position 15 of the secondary force transfer shaft is shown by example only, and those of skill in the art will appreciate that the position can by varied at any point along the single bar force transfer actuator 7 to achieve many objectives, such as increased performance or ease of construction, and still fall within the present invention. The operation of the additional force transfer shaft is described in more detail below.

As can be seen from FIG. 3B, both the rotational entry shaft 8 and the force transfer shaft 9 project from the single bar force transfer actuator toward the outside the door. The projected end 16 of the rotational entry shaft 8 passes through the rotational shaft travel slot 10 and through the safe or security door and engages or is connected to the wheel or handle or other opening mechanism on the outside of the safe or security door. The projected end 17 of the force transfer shaft 9 passes through the force transfer shaft travel slot 11.

Referring again to FIG. 2A, the safe or security door and the force deflector are in the unlocked position, and as the handle or other opening mechanism of the safe or security door is turned (to open the door), the rotational entry shaft 8 rotates, but because it is merely a shaft it turns but does not move spatially. Because the rotational entry shaft 8 is welded or otherwise attached to the single bar force transfer actuator 7, which in turn is welded or otherwise attached to the force transfer shaft 9, the single bar force transfer actuator 7 and the force transfer shaft 9 rotate as well. During rotation, the single bar force transfer actuator 7 and the force transfer shaft 9 also move spatially, unlike the rotational entry shaft 8 that merely turns around a single point, when the handle or other opening mechanism of the safe or security door is turned. When the rotational entry shaft 8 rotates, and the single bar force transfer actuator 7 and the force transfer shaft 9 rotate and move spatially, the force transfer shaft 9 engages the force transfer plate 6 through the force transfer shaft travel slot 11.

As the rotational shaft 8 continues to rotate, the force transfer shaft 9 continues to engage the force transfer plate 6 through the force transfer shaft travel slot 11 and as a result, causes the force transfer plate 6 to move spatially (horizontally) away from the side of the safe or security door. In FIG. 2A this is evident from the positions of the tongue 13 and the slot 14. As shown, the tongue 13 of the locking mechanism 12 is withdrawn from slot 14, and as the force transfer plate 6 moves spatially (horizontally) away from the side of the safe or security door, the locking mechanism 12 (and tongue 13) stay stationary and the slot 14, which is part of and moving with the force transfer plate 6, cannot be engaged by the tongue 13.

As the rotation continues and the force transfer plate 6 continues to move away from the side of the safe or security door, the force transfer shaft 9 travels up the force transfer travel slot 11. The force transfer travel slot 11 both allows engagement between the force transfer shaft 9 and the force transfer plate 6 and allows the force deflector plate 6 to continue to move spatially away from the side of the safe or security door as rotation continues. It is understood that the single bar force transfer actuator 7 may have two or more force transfer shafts 9 connected to it and each such force transfer shaft 9 would have a corresponding force transfer slot 11 in the force transfer plate 6. It is also understood that the single bar force transfer actuator 7 may have an optional secondary force transfer shaft or shafts, which would operate in the same manner as the force transfer shaft or shafts 9. Also, just as the projected end 17 of the force transfer shaft 9 passes through the force transfer shaft travel slot 11, the projected ends of any secondary force transfer shafts 9 at position 15 would also pass through the force transfer plate 6 via force transfer shaft travel slots 11 and allow any such secondary force transfer shafts to both engage the force transfer plate 6 and allow the force deflector plate 6 to continue to move spatially away from the side of the safe or security door as rotation continues.

Again referring to FIG. 2A, at the same time as the movement of the force transfer shaft 9 and as the force deflector plate 6 moves away from the side of the safe or security door, the rotational shaft travel slot 10 provides an opening for the rotational shaft 8 to prevent the rotational shaft 8 from preventing the movement of the force deflector plate 6. The rotational shaft travel slot 10 allows the force deflector plate 6 to continue to move away from the side of the safe or security door as rotation continues.

In other words, the force transfer travel slot 11 allows the force transfer shaft 9 to engage the force transfer plate 6 and allows the force transfer plate 6 to continue to move away from the side of the safe or security door as rotation continues, while the rotational shaft travel slot 10 allows the force transfer plate 6 to continue to move away from the side of the safe or security door as rotation continues by providing a space for the rotational entry shaft 8 to rotate without coming into contact with, and preventing the movement of, the force transfer plate 6.

As rotation continues, because the force transfer plate 6 is connected to the locking pin connection plate 5 and the force transfer plate 6 move spatially toward the middle of the safe or security door, the locking pin connection plate 5 also moves spatially toward the middle of the safe or security door. As a result, the locking pins 3 are withdrawn from the door frame 2 and/or the sides of the safe or security door and accordingly the door may be opened.

To close the door, before the locking mechanism 12 is actuated, the handle or opening mechanism is operated, usually by turning in the opposite direction, to cause the above-described process to proceed in reverse. When reversed, the locking pin connection plate 5 and the force transfer plate 6 move spatially away from the middle of the safe or security door and toward the edge of the safe or security door. In such a manner, the locking pins 3 are inserted behind or into the door frame 2 and/or the sides of the safe or security door. In this manner the safe or security door is closed and prepared for locking.

Now referring to FIG. 2B, the safe or security door with the force deflector is shown in the closed and locked position. The tongue 13 of the lock is shown extended into the tongue lock slot 14—the opening for the tongue—in the top of the force transfer plate 6. The tongue 13 is separated from the edge of the force transfer plate 6 in the tongue lock slot 14 by a distance 18.

The single bar force actuator 7 is shown in the horizontal position perpendicular to the locking pin connection plate 5. The rotational entry shaft 8 and the force transfer shaft 9 are aligned with each other, in this case horizontally, and are aligned in a plane perpendicular to the locking pin connection plate 5.

The force transfer shaft 9, which engages the force transfer plate 6 through the force transfer shaft travel slot 11, is separated from the edge of the force transfer shaft travel slot 11 by a distance 19. Distance 19 can be any distance, including zero, which means that the force transfer shaft 9 is in contact with the force transfer plate 6 and the point of contact is the edge of the force transfer shaft 9 where it passes through the force transfer shaft travel slot 11. Preferably, although it is not required, the distance 19 is less than the distance 18 so that with the locking mechanism 12 activated (and therefore the tongue 13 extended into the slot 14), the force transfer plate 6, as it moves spatially (horizontally), would engage, or come into contact with, the force transfer shaft 9 before it would engage, or come into contact with, the tongue 13.

If the distance 19 is more than the distance 18 so that as the force transfer plate 6 moves it engages the tongue 13 before the force transfer shaft 9, the force deflector will still work because the tongue 13 will deflect and can absorb some movement, thereby allowing the force transfer plate 6 to engage or come into contact with the force transfer shaft 9. Accordingly, if the distance 19 is more than the distance 18, the tongue 13 will deform or bend to a certain extent before failing, allowing time and distance for the force transfer plate 6 to engage or come into contact with the force transfer shaft 9.

With the safe or security door and the force deflector in the locked position, any force applied to any of the locking pins 3 is transferred to the safe or security door without damaging the tongue 13, thereby preventing the locking mechanism from being disabled. Specifically, when a force is applied to any of the locking pins 3, the force is transferred to the locking pin connection plate 5. From the locking pin connection plate 5, the force travels to the force deflector plate 6. Because the force deflector plate 6 is in contact with, or separated by a distance of 19 from the force transfer shaft 9, as the force transfer plate 6 comes into contact with the force transfer shaft 9, the applied force is transferred from the force transfer plate 6 to the force transfer shaft 9. Likewise, because the force transfer shaft 9 is welded or otherwise attached to the single bar force transfer actuator 7, which in turn is welded or otherwise attached to the rotational entry shaft 8, the applied force is transferred from the force transfer shaft 9 to the rotational entry shaft 8. Finally, because the rotational entry shaft 8 is in contact or close communication with the safe or security door itself, the applied force is transferred to the safe or security door. In summary, the force applied to locking pins 3 is transferred from the force transfer shaft 9 through the single bar force transfer actuator 7, through the rotational entry shaft 8 to the safe or security door where it is harmlessly absorbed and dissipated.

Without this system, any force applied to the locking pins 3 is transferred to the tongue 13. Specifically, when a force is applied to any of the locking pins 3, the force is transferred to the force deflector plate 6 through the locking pin connection plate 5. Without the interaction described above involving the force transfer plate 6, the single bar force transfer actuator 7, the rotational entry shaft 8, the force transfer shaft 9, and the travel slots 10 and 11, any force applied to the locking pins 3 is transferred from the force transfer plate 6 directly to the tongue 13. Similarly, if the force deflector plate 6 is separated by a distance of 19 from the force transfer shaft 9, but that distance 19 is greater than the distance 18 between the tongue 13 and the tongue locking slot 14, the force transfer plate 6, as it moves spatially (horizontally) due to any applied force, would engage the tongue 13 before it would engage the force transfer shaft 9.

When applied to the tongue 13, experience has shown that if the force is great enough, the tongue 13 is sheared or otherwise broken or disabled. As the tongue 13 is an important component of the locking system, and sometimes the only or main component of the locking system, once it is sheared off, disabled, or broken, the wheel or handle or other such device on the outside of the safe or security door can be activated to rotate the rotational entry shaft. As previously explained, this ultimately withdraws and disengages the locking pins 3 from the door frame 2 and/or the sides of the safe or security door. At that point the safe or security door is opened, without the use of the proper entry permission parameter combination or key. Accordingly, by deflecting the force away from the tongue 13, the force deflector prevents a means of unauthorized entry into the safe or security door.

Those of skill in the art will appreciate that many variants of the above-described force deflector are possible and all fall within the present invention. For example, in an alternative operation, another locking pin connection plate 5 is added to the side of the door opposite from the current locking pin connection plate 5. Those of skill in the art would appreciate that conceptually there is no limit to the number, locations, or shapes of locking pin connection plates 5 (and locking pins 3) and multiple such devices may be located on the sides, top, and bottom of the safe or security door. The only restraint to such devices is the physical limitation of size and placement—the locking pin connection plates and pins must be configured to allow operation of the safe or security door.

Figures 4A, 4B:
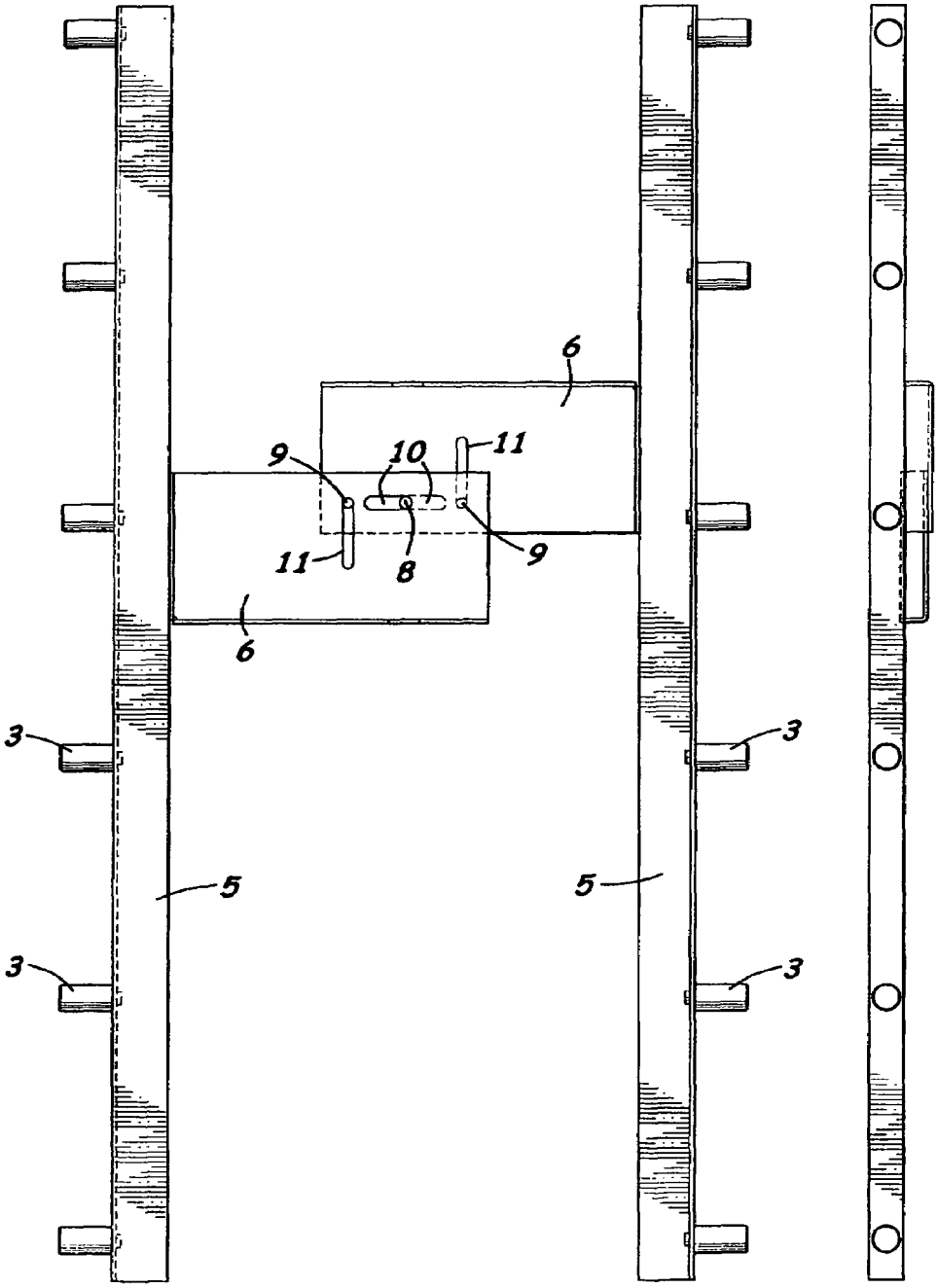
FIGS. 4A and 4B show a double force deflector with two force transfer plates and a single bar force actuator and force transfer pins.

For illustration, FIGS. 4A and 4B show a force deflector using two locking pin connection plates 5, two force transfer plates 6, and a single bar force transfer actuator 7. As shown in FIGS. 3A and 3B, the single bar force transfer actuator 7 may have two force transfer shafts 9, and in this case it does. The secondary force transfer shaft 9 at position 15 allows the single bar force transfer actuator 7 to (1) engage a single force transfer plate 6 at multiple locations (through force transfer shaft travel slots 11), (2) engage multiple force transfer plates 6, and (3) to engage multiple force transfer plates 6 at multiple locations.

Those of skill in the art will appreciate that the size and shape of the force transfer shafts 9, including the secondary force transfer shaft, may be varied to achieve any number of desired goals, such as the best possible security or ease of use of the mechanism. Those of skill in the art will also appreciate that although FIG. 4A shows two locking pin connection plates 5 on one side of the door and two force transfer plates 6, multiple locking pin connection plates 5 and multiple force transfer plate 6 could be added, and may interact with multiple single bar force transfer actuators 7 and still fall within the scope of the present invention.

In operation, the force deflector depicted in FIGS. 4A and 4B operates in a similar manner as that described above. As the handle or other opening mechanism of the safe or security door is turned (with the goal being to open the door), the rotational entry shaft 8 rotates and the single bar force transfer actuator 7 and the force transfer shafts 9 move in an arc pattern. The arc pattern of movement of the single bar force transfer actuator 7 and the force transfer shafts 9 is created because these devices rotate and at the same time move spatially as the handle or other opening mechanism of the safe or security door is turned. The force transfer shafts 9 also engage the two force transfer plates 6 through the force transfer shaft travel slots 11 (one in each force transfer plate 6). The force transfer travel slots 11 both allow engagement between the force transfer shafts 9 and the force transfer plates 6 and allow the force deflector plates 6 to continue to move away from the sides of the safe or security door (and toward the middle of the door) as rotation continues. Simultaneously, as the rotational entry shaft 8 rotates, the force deflector plates 6 travel along the two rotational shaft travel slots 10 (one in each force transfer plate 6); this allows the force deflector plates 6 to continue to move away from the side of the safe or security door as rotation continues.

As rotation continues the two locking pin connection plates 5 and the two force transfer plates 6 move spatially toward the middle of the safe or security door and toward each other. In this manner the rotation withdraws the locking pins 3 from the sides of the safe or security door and allows the door to be opened. To close the door, before the locking mechanism 12 is activated, the handle or opening mechanism is operated, usually by turning in the opposite direction, to cause the above-described process to proceed in reverse. When reversed, the locking pin connection plates 5 and the force transfer plates 6 move spatially away from the middle of the safe or security door (and away from each other) and toward the door edge and the locking pins 3 are inserted behind or into the door frame 2 and/or sides of the safe or security door. In this manner the safe or security door is closed and prepared for locking; i.e. the door is closed, the locking pins are inserted, and the locking mechanism 12 can be activated to lock the safe or security door.

The force deflector depicted in FIGS. 4A and 4B with the secondary force transfer shaft 9 depicted in FIGS. 3A, and 3B has several unique and beneficial characteristics. Although it is understood that this force deflector will operate with a single force transfer shaft 9 (engaging both force transfer plates 6), more force transfer shafts offer improved performance and two such shafts are shown here (the force transfer shaft 9 and the secondary force transfer shaft at position 15). Because of the secondary force transfer shaft 9 and the additional force transfer plate 6, any force applied to any of the locking pins 3, on any side of the safe or security door, is transferred away from the tongue 13 through the force transfer shafts 9, thereby preventing the locking mechanism from being disabled. Specifically, when a force is applied to any of the locking pins 3, the force is transferred to one of the locking pin connection plates 5. From the locking pin connection plate 5, the force travels to one of the force deflector plates 6. As the force transfer plate 6 comes into contact with one of the force transfer shafts 9, some of the applied force is transferred from the force transfer plate 6 to the force transfer shaft and eventually to the safe or security door through the single bar force transfer actuator 7 and the rotational entry shaft 8. Some of the force, however, is transferred from the force transfer shaft 9 through the single bar force transfer actuator 7 to the other force transfer shaft 9. In this manner, some of the force is transferred to the second force deflector plate 6 and ultimately the side of the safe or security door. This division and distribution of the applied force necessarily prevents any one component from bearing the full applied force, improves the deflection and absorption of the applied force, and prevents a means of unauthorized entry into the safe or security door. By expanding the number of force transfer shafts and having each engage multiple force deflector plates 6, the applied force can be further divided and distributed.

Additionally, as a result of the multiple force transfer plates 6, the force deflector can use multiple locking mechanisms 12 positioned at different locations on door 1. Accordingly, the safe or security door would be more secure.

An alternative modification to the force deflector depicted in FIGS. 4A and 4B involves using two single bar force transfer actuators 7, one for each force transfer plate 6. In operation, one of the two single bar force transfer actuators 7 engages one of the two force transfer plates 6 through the force transfer shaft travel slot 11 by way of the force transfer shaft 9, while the second single bar force transfer actuator 7 engages the remaining force transfer plate 6 in the same fashion. As the handle or other opening mechanism is activated on the safe or security door, the two single bar force transfer actuators 7 cause the two locking pin connection plates 5 and the two force transfer plates 6 move spatially toward the middle of the safe or security door and toward each other, and ultimately the locking pins 3 to be withdrawn from the sides of the safe or security door. In this manner, the door may be opened. By expanding the number of force transfer actuators 7 and having each engage multiple force deflector plates 6, the applied force can be further divided and distributed.

Figure 5A:
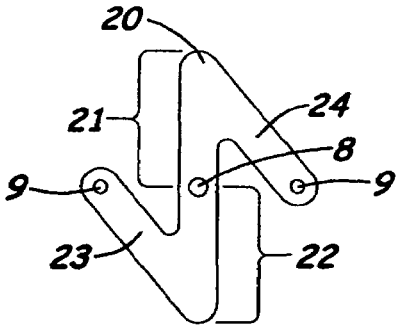
FIGS. 5A, 5B, 5C, and 5D show a double force deflector with two force transfer plates and a single bar offset force actuator and force transfer pins mounted on a safe door.
Figure 5B:
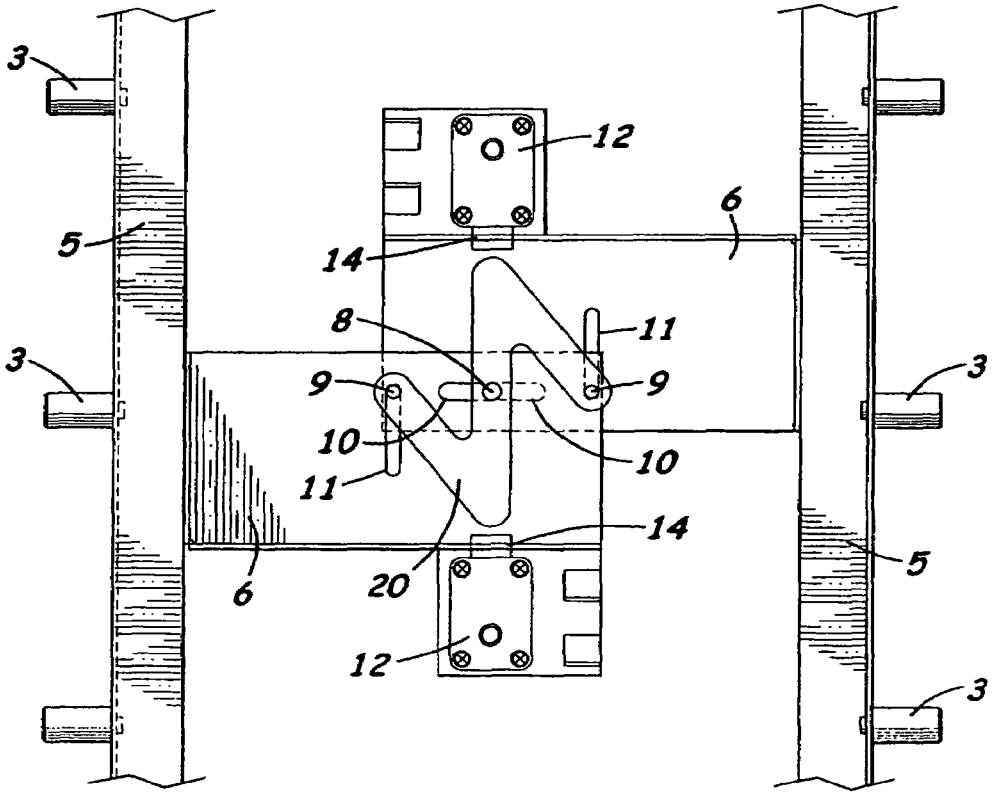

Another exemplary alternative is set forth in FIGS. 5A and 5B, which depict a double bar force transfer actuator 20. Similar to the force deflector depicted in FIGS. 4A and 4B, the additional force transfer shaft 9, which corresponds to a second force transfer plate 6, transfers any force applied to any of the locking pins 3, on any side of the safe or security door, away from the tongue 13, thereby preventing the locking mechanism from being disabled. Again, as with the force deflector shown in the locked position in FIG. 2B, FIG. 5B shows the alternative arrangement in the locked position with the force transfer shafts 9 aligned with the rotational entry shaft 8 (in this case horizontally) and aligned in a plane perpendicular to the locking pin connection plate 5.

One advantage of such a system results from the multiple force transfer plates 6, which can be used in conjunction with multiple locking mechanisms 12 positioned at different locations on door 1 to improve security. Additional advantages of the force deflector shown in FIGS. 5A and 5B stem from the offset nature of the offset distance 21 or 22 between each of the force transfer ends 23 and 24 of the double bar force transfer actuator 20. The offset distance 21 or 22 allows the size and shape of force transfer plates 6 to be changed, and by varying the offset distance 21 or 22, additional space around the rotational entry shaft 8 and the locking mechanism 12 can be created and controlled. The additional space is beneficial for ease of manufacturing and repair, as well as because it allows additional space for optional locking mechanisms to be used.

Figure 5C:
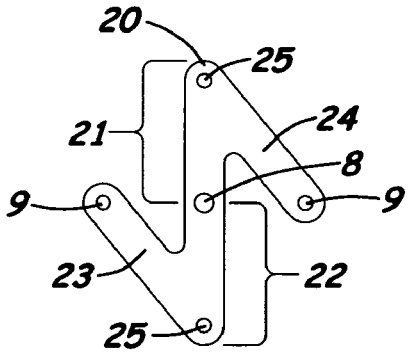
Figure 5D:
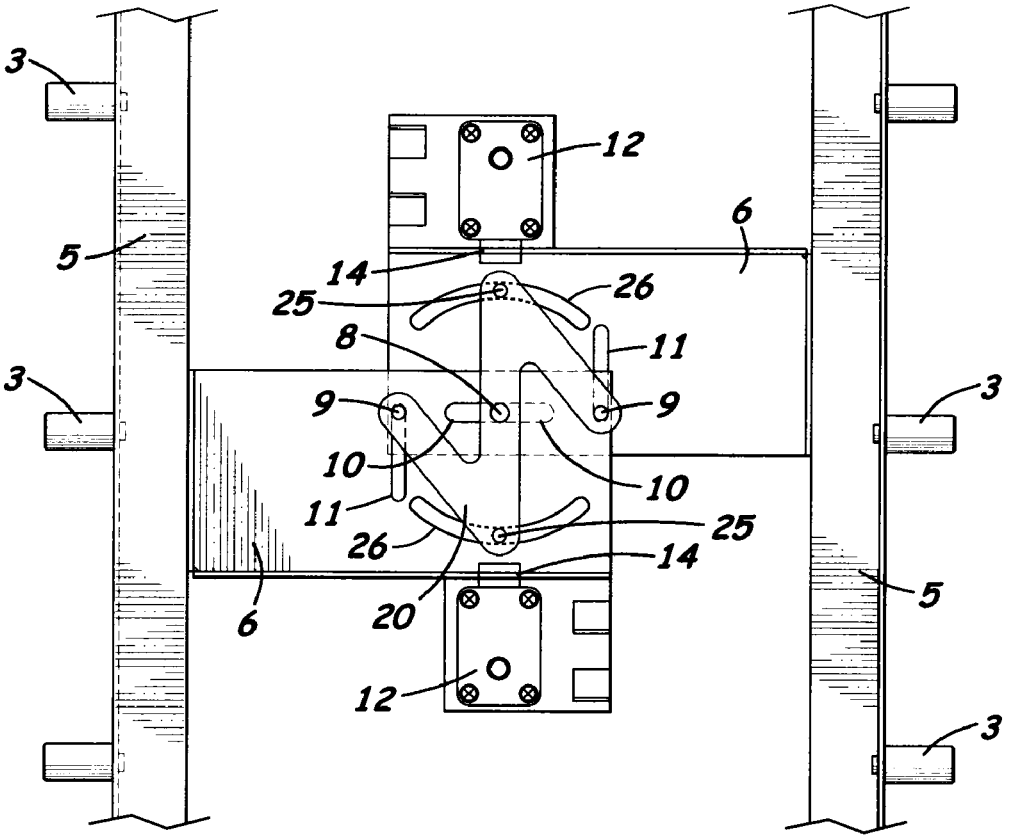

FIGS. 5C and 5D show an another alternative arrangement with additional advantages. Two additional force transfer shafts 25 are shown, one in each of the force transfer ends 23 and 24 of the double bar force actuator 20. Again, as with the force deflector shown in the locked position in FIG. 2B, FIG. 5D shows the alternative arrangement in the locked position with the force transfer shafts 9 aligned with the rotational entry shaft 8 (in this case horizontally) and aligned in a plane perpendicular to the locking pin connection plate 5. Additionally, the two additional force transfer shafts 25 also aligned with the rotational entry shaft 8 (in this case vertically).

The force transfer shafts 25 correspond to two additional force transfer travel slots 26, one in each of the force transfer plates 6. One advantage of the force transfer shafts 25 is that any applied force is divided between four such shafts, further preventing any one component from bearing the total applied force, improving the deflection and absorption of the applied force, and preventing a means of unauthorized entry into the safe or security door.

Those of skill in the art will also appreciate that although FIGS. 5A and 5C show two locking pin connection plates 5 on one side of the door and two force transfer plates 6, multiple locking pin connection plates 5 and multiple force transfer plate 6 could be added, and may interact with multiple double bar force transfer actuators 20 and still fall within the scope of the present invention.

Although the systems described above have been discussed in relation to a safe or security door, those systems may be adapted to other door types with minor modification, for example garage doors or access doors of many other types. The scope of use of the above described force deflector should therefore be interpreted broadly rather than restrictively.

While various systems incorporating a force deflector have been described and illustrated in conjunction with a number of specific configurations and methods, those skilled in the art will appreciate that variations and modifications may be made without departing from the principles herein illustrated, described, and claimed. The present invention, as defined by the appended claims, may be embodied in other specific forms without departing from its spirit or essential characteristics. The configurations described herein are to be considered in all respects as only illustrative, and not restrictive. All changes which come within the meaning and range of equivalency of the claims are to be embraced within their scope.

What is claimed is:

1. A safe or security door comprising:

a locking mechanism with an extendable and retractable tongue;

a locking pin connected to a locking pin connection plate;

a force transfer plate with an opening to receive the tongue from the locking mechanism, said force transfer plate further having a slot;

a rotational entry shaft connected to a single bar force transfer actuator with a single force transfer shaft, wherein said entry shaft, actuator and transfer shaft are positioned relative to said transfer plate such that said force transfer shaft is located in said slot and wherein rotation of said entry shaft extends or retracts said locking pins by way of movement of said locking pin connection plate and said force transfer plate;

wherein in the door locked status said force transfer shaft is positioned in contact or near contact with said slot, and further wherein said locking pin and force transfer plate are restrained in the closed position by the contact or near contact of said force transfer shaft in said slot, further wherein said force transfer shaft is restrained in position by said transfer actuator and said rotational entry shaft; and wherein said slot is aligned substantially perpendicular to the direction of locking pin travel, and further wherein said slot is aligned in a direction such that under conditions of a force applied to said locking pin in the direction of pin retraction, the position of said force transfer shaft within said slot is restrained in the closed position.

2. A safe or security door according to claim 1, further comprising: multiple locking pins connected to the locking pin connection plate.

3. A safe or security door according to claim 1, further comprising: wherein said single bar force transfer actuator is connected to multiple force transfer shafts.

4. A safe or security door according to claim 1, wherein said force transfer plate opening is configured to provide a sufficient distance between said transfer plate and said tongue in the locked position that a force applied to said locking pin in the direction of pin retraction is transferred to any of said plate, actuator or shaft and not to said tongue.

5. A safe or security door according to claim 1, wherein said force transfer plate opening is configured to provide a sufficient distance between said transfer plate and said tongue in the locked position that a force applied to said locking pin in the direction of pin retraction is transferred to any of said plate, actuator or shaft before failure of said locking mechanism or said tongue, allowing for some deflection or movement of said locking mechanism and said tongue.

6. A safe or security door comprising:

a door frame;

a lock with an extendable and retractable locking bar;

latches connected to a latch plate;

a force transfer bar connected to the latch plate, with the force transfer bar having an opening to receive the locking bar, said force transfer bar further having a slot;

a rotational entry pin connected to a single bar force transfer rod with a single force transfer pin, wherein said entry pin, rod and transfer pin are positioned relative to said transfer bar such that said force transfer pin is located in said slot and wherein rotation of said entry pin extends or retracts said latches by way of movement of said latch plate and said force transfer bar;

wherein when in locked status the latches engage the door frame and the locking bar engages the force transfer bar thereby preventing the door from being opened;

wherein in the locked status said force transfer pin is positioned in contact or near contact with said slot, and further wherein said latches and force transfer bar are restrained in the closed position by the contact or near contact of said force transfer pin in said slot, further wherein said force transfer pin is restrained in position by said transfer rod and said rotational entry pin; and wherein said slot is aligned substantially perpendicular to the direction of latch travel, further wherein said slot is aligned in a direction such that under conditions of a force applied to any of said latches in the direction of retraction, the position of said force transfer shaft within said slot is restrained in the closed position.

7. A safe or security door according to claim 6, wherein said force transfer bar opening is configured to provide a sufficient distance between said transfer bar and said locking bar in the locked position that a force applied to any one of said latches in the direction of retraction is transferred to any of said transfer bar, force transfer pin or rotational entry pin and not to said locking bar.

8. A safe or security door according to claim 6, wherein said force transfer bar opening is configured to provide a sufficient distance between said transfer bar and said locking bar in the locked position that a force applied to any one of said latches in the direction of retraction is transferred to any of said transfer bar, force transfer pin or rotational entry pin before failure of said lock or said locking bar, allowing for some deflection or movement of said lock and said locking bar.

9. A safe or security door comprising:

a locking mechanism with an extendable and retractable tongue;

a locking pin connected to a locking pin connection plate;

a force transfer plate with an opening to receive the tongue from the locking mechanism, said force transfer plate further having a slot;

a rotational entry shaft connected to a single bar force transfer actuator with a single force transfer shaft, wherein said entry shaft, actuator and transfer shaft are positioned relative to said transfer plate such that said force transfer shaft is located in said slot and wherein rotation of said entry shaft extends or retracts said locking pins by way of movement of said locking pin connection plate and said force transfer plate;

wherein in the door locked status said force transfer shaft is positioned in contact or near contact with said slot, and further wherein said locking pin and force transfer plate are restrained in the closed position by the contact or near contact of said force transfer shaft in said slot, further wherein said force transfer shaft is restrained in position by said transfer actuator and said rotational entry shaft;

wherein said slot is aligned substantially perpendicular to the direction of locking pin travel, further wherein said slot is aligned in a direction such that under conditions of a force applied to said locking pin in the direction of pin retraction, the position of said force transfer shaft within said slot is restrained in the closed position; and wherein a force less than the force required to cause failure of said locking mechanism reaches said tongue under the conditions of (1) said door is in locked status and (2) a force is applied to any one of said locking pins in the direction of pin retraction, that force being less than that required to cause failure of any of said force transfer plate, said rotational entry shaft and said actuator.

10. A safe or security door according to claim 9, wherein said force transfer plate opening is configured to provide a sufficient distance between said transfer plate and said tongue in the locked position that a force applied to said locking pin in the direction of pin retraction is transferred to any of said plate, actuator or shaft and not to said tongue.

11. A safe or security door according to claim 9, wherein said force transfer plate opening is configured to provide a sufficient distance between said transfer plate and said tongue in the locked position that a force applied to said locking pin in the direction of pin retraction is transferred to any of said plate, actuator or shaft before failure of said locking mechanism or said tongue, allowing for some deflection or movement of said locking mechanism and said tongue.

* * * * *